US005765442A

United States Patent [19]

Judson

[11] Patent Number: 5,765,442

[45] Date of Patent: Jun. 16, 1998

[54] PORTABLE PEDAL CONTROL DEVICE

[76] Inventor: Rickie L. Judson, 3 Lippett Ave., Johnstown, Colo. 80534

[21] Appl. No.: 647,068

[22] Filed: May 9, 1996

[51] Int. Cl.[6] ..... G05G 11/00

[52] U.S. Cl. ..... 74/481; 74/482; 74/484 R; 294/19.1

[58] Field of Search ..... 74/480 R, 481, 74/482, 484 R; 294/19.1, 50.9

[56] References Cited

U.S. PATENT DOCUMENTS

| | | | |
|---|---|---|---|
| 2,481,966 | 9/1949 | Zivi . | |
| 2,660,467 | 11/1953 | Lenth | 294/50.9 |
| 2,794,667 | 6/1957 | Bissitt | 74/481 |
| 3,065,647 | 11/1962 | Whitmore . | |
| 4,424,723 | 1/1984 | Gockel . | |
| 5,056,842 | 10/1991 | Lindenberg | 294/19.1 |
| 5,119,688 | 6/1992 | Snyder . | |
| 5,121,651 | 6/1992 | Bristow . | |
| 5,154,466 | 10/1992 | Neuhaus | 294/50.9 |
| 5,387,021 | 2/1995 | Brewer | 294/19.1 |
| 5,403,332 | 4/1995 | Christoudias | 294/19.1 |
| 5,542,312 | 8/1996 | Peters | 74/481 |

*Primary Examiner*—Charles A. Marmor
*Assistant Examiner*—David M. Fenstermacher
*Attorney, Agent, or Firm*—Dean P. Edmundson

[57] ABSTRACT

A portable pedal control device for use by a disabled person to control the brakes and accelerator in a vehicle. One such control device is to be attached to the brake pedal and another similar device is attached to the accelerator pedal. The control device includes: (a) an elongated shaft or body, (b) opposing claws on the lower end of the shaft, (c) a lever for moving one of the claws between open and closed positions, and (d) a spring to hold the movable claw in its closed position. The control device is easily attached to the desired pedal by operating the lever to open the claws, then the claws are placed around the pedal and closed again. No tools are required, and the operator (disabled person) can attach or detach the control device without any assistance and without having to reach to the floor of the vehicle to manipulate fasteners or the like. The control devices can be used on any vehicle by a disabled person.

15 Claims, 3 Drawing Sheets

PORTABLE PEDAL CONTROL DEVICE

FIELD OF THE INVENTION

This invention relates to vehicle controls. More particularly, this invention relates to vehicle foot pedal controls. Even more particularly, this invention relates to devices which can be used by disabled persons to operate vehicle foot pedals for the brakes and accelerator.

BACKGROUND OF THE INVENTION

People who do not have full use of one or both legs or feet are unable to safely operate a conventional motor vehicle because they are unable to manipulate the standard foot controls for the brakes or accelerator. To overcome this problem, there have been developed various types of hand-operated lever systems for use by the operator in controlling foot pedals in vehicles. Some of such systems require various mounting brackets which must be secured to the dash, floor, or steering column of the vehicle and are custom-designed and installed on the operator's personal vehicle at considerable expense. Consequently, such systems are limited to one particular vehicle for use by the disabled person.

Hand-operated control levers have also been proposed which are secured to the foot pedals at their lower end and are supported in an upright position at their upper end on or near the steering column. See, for example, U.S. Pat. Nos. 3,065,647 and 4,424,723. Such systems require special brackets or hardware and also require that the controls be secured to the foot pedals with screws, bolts or clamps. Consequently, such systems are cumbersome, difficult or sometimes impossible to install by a disabled person. After they are installed on a particular vehicle, it is not convenient or practical for them to be removed until the disabled person acquires a different personal vehicle.

Other hand-control systems have been proposed which do not require special mounting brackets for the dash or steering column, but such systems still are difficult or cumbersome to attach to the foot pedals. See, for example, U.S. Pat. Nos. 2,481,966; 5,119,688; and 5,121,651. As a result, it is not practical for a disabled person to be able to attach or detach the controls at will. This is a very significant limitation which unduly restricts a disabled person to the use of a particular vehicle.

Three has not heretofore been provided a simple, easy to operate, hand-control system for use by a disabled person on any vehicle of his or her choice.

SUMMARY OF THE PRESENT INVENTION

In accordance with the present invention there is provided a portable control system for use by a disabled person to operate the foot pedals of any vehicle for controlling the brakes and the accelerator. The control system can be very easily connected to the foot pedals by the disabled person without tools or special hardware and without having to reach down to the foot pedals or crawl under the dash, etc.

The control system is self-contained and truly portable. A disabled person can connect the control devices in a matter of seconds without assistance and can also readily detach them very quickly. The control devices can be carried by a disabled person while traveling (e.g., in a plane, bus or train) and then used to operate any vehicle upon reaching his or her destination without modifying the controls or obtaining any auxiliary hardware, tools, etc.

In a preferred embodiment the portable control devices of the invention comprise:

(a) an elongated body or shaft having upper and lower ends;

(b) opposing first and second claw means secured to the lower end of the body member; wherein the spacing between the first and second claw means is adjustable;

(c) lever means for moving the first claw means between open and closed positions; and (d) bias means for biasing the first claw means toward its closed position.

The opposing claws on the lower end of the device are operated by the user holding the upper end of the device. Thus, the operator can easily open the claws so that they will reach around a desired foot pedal, and then the claws can be closed so as to firmly and securely connect the lower end of the control device to the foot pedal. The upper end of the control device can rest on top of the vehicle seat next to the operator. As a result, the operator need only grasp the upper end of the control device in order to be in a position to control that particular foot pedal. When separate control devices are connected to the brake pedal and the accelerator, the operator has full control of the foot pedals in a vehicle with an automatic transmission. When the operator desires to operate a different vehicle, he or she can readily detach the control devices and move to another vehicle and attach the devices in seconds.

Other advantages of the control devices of the invention will be apparent from the following detailed description and the accompany drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
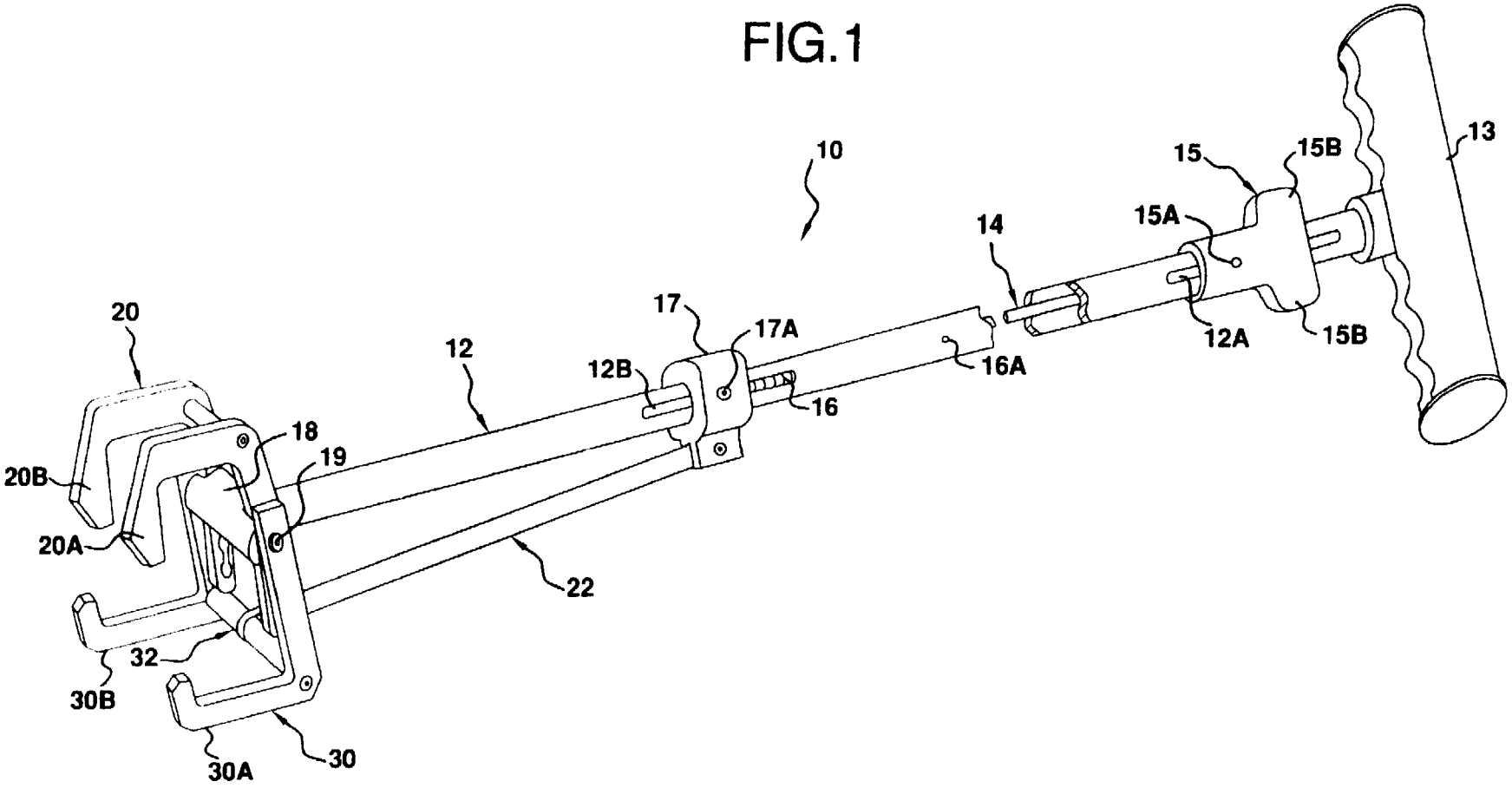
FIG. 1 is a perspective view of a preferred embodiment of hand-control device of this invention.

In the drawings there is shown a preferred embodiment of a hand control device 10 of the invention. The device includes an elongated shaft or body member 12, opposing claw means 20 and 30, lever means 14 for moving claw means 30 between open and closed positions, and bias means 16 for biasing claw means 30 toward its closed position.

The lever means 14 includes an upper end secured to collar member 15 by means of a pin 15A which extends through collar 15 and elongated slot 12A near the upper end of shaft 12. The lever means 14 extends downwardly through the interior cavity of tubular shaft 12 to a point which is accessible in elongated slot 12B where the lower end of lever 14 is secured to collar member 17 (by means of pin 17A passing through collar 17, slot 12B and also the lower end of lever 14). Spring or bias means 16 inside shaft 12 biases the collar 17 toward the lower end of shaft 12 (i.e., away from the upper end of shaft 12 and handle 13). The spring 16 is secured at one of its ends by pin 16A extending transversely through shaft 12. The opposite end of the spring is attached to pin 17A.

Claw means 30 preferably comprises a pair of spaced-apart claws 30A and 30B which are the same size and shape and which are each pivotally mounted on their upper ends to bracket 18 on the lower end of shaft 12 by means of pin or bolt 19. Claws 30A and 30B each include an upturned free end as shown.

Claw means 20 preferably also comprises a pair of spaced-apart claws 20A and 20B which are the same size and shape as each other and include downwardly projecting free ends. These claws are secured to bracket 18 in a fixed position. Bolt 19 may serve this purpose for each claw 20A and 20B. In other words, a bolt 19 serves a double purpose of attaching the claw 30A and also claw 20A to one side of bracket 18. Another similar bolt 19 attaches claw 30B and claw 20B to the other side of bracket 18.

Connecting rod 22 is secured at one end to collar 17 and is attached at its opposite end to cross-member 32 between the spaced-apart claws 30A and 30B. Thus, as the lever 14 is moved upwardly in shaft 12 by lifting on collar 15, collar 17 is caused to move toward handle 13. This results in connecting rod 22 pivoting the claws 30A and 30B away from claws 20A and 20B, i.e., the claws 30A and 30B are moved to an open or retracted position. By releasing collar 15, the claws 30A and 30B pivot about bolt 19 to their closed position automatically by means of the spring 16.

Thus, in the device of this invention, the opposing claw means 20 and 30 are capable of being easily opened by simply moving the collar upwardly toward handle 13. The presence of ears 15B on opposite sides of collar 15 facilitate grasping and lifting of collar 15. When the claws are in their open position, they can be easily positioned around a vehicle brake pedal or accelerator pedal, after which collar 15 is released to allow the spring 16 to close the claws around the pedal.

Figure 2:
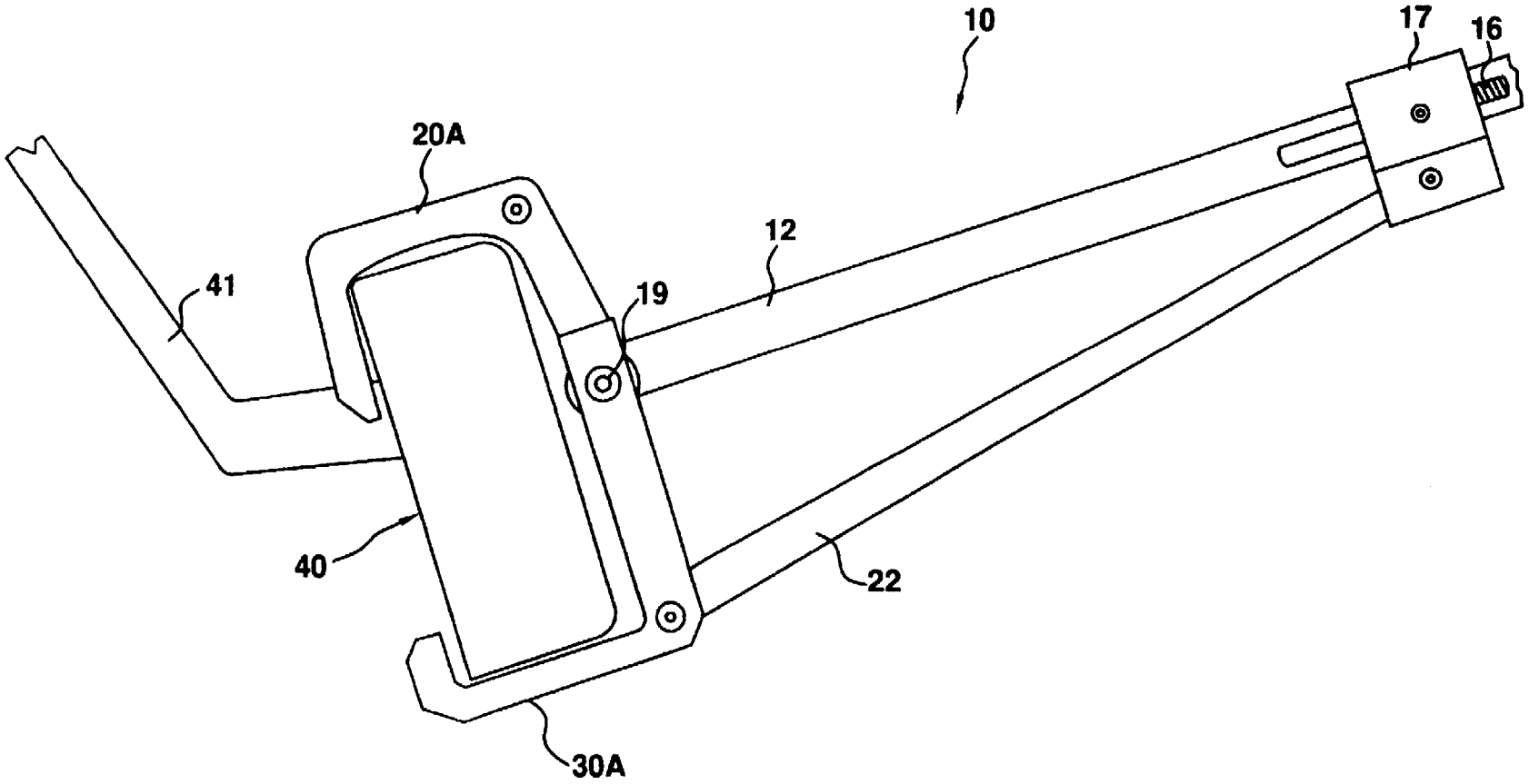
FIG. 2 is a side view showing the hand-control device of FIG. 1 attached to a vehicle brake pedal.
Figure 3:
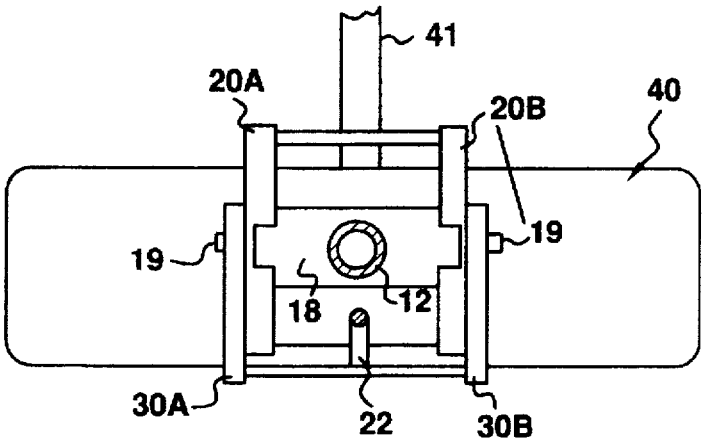
FIG. 3 is a top view of the hand-control device of FIG. 1 attached to the brake pedal of a vehicle.

FIG. 2 is a side elevational view showing a control device of FIG. 1 attached to a vehicle brake pedal 40. The fixed claws 20A and 20B rest on top of, and extend over, the top of the brake pedal. The pivoting claws 30A and 30B extend under and upwardly behind the brake pedal. FIG. 3 is a front view of the apparatus shown in FIG. 2, partially cutaway, to show that the fixed claws are positioned on opposite sides of the brake pedal arm 41. This arrangement is desirable because when the claws are in their closed position, the control device cannot slip off of the brake pedal during normal use.

Figure 4:
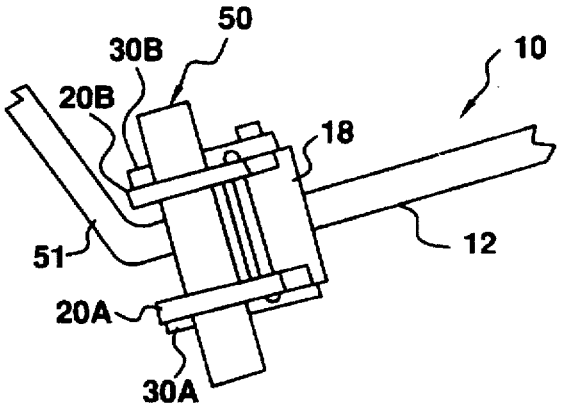
FIG. 4 is a side-elevational view of a hand-control device of FIG. 1 attached to an accelerator pedal.

FIG. 4 is a side elevational view showing a control device of the invention attached to a vehicle accelerator pedal 50 on the lower end of arm 51. In this particular use the control device is positioned such that claws 20B and 30B are above pedal arm 51 and claws 20A and 30A are below arm 51. This arrangement prevents the control device from slipping downwardly (or upwardly) off the pedal arm.

Figure 5:
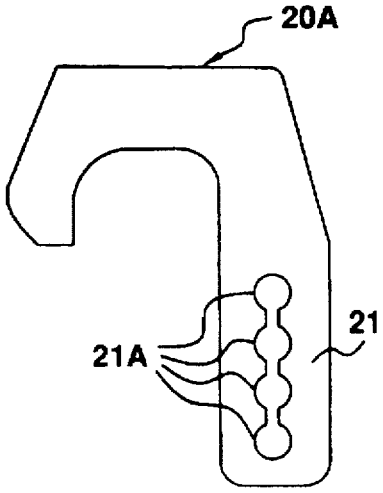
FIG. 5 is a side elevational view of a claw member useful in the hand-control device which allows for adjustable mounting on the lower end of the device.

Another feature of the control device of the invention is that the spacing between the fixed claws and the pivoting claws is adjustable. This is extremely beneficial and advantageous because it enables the control device to be safely and securely connected to vehicle pedals of any size and shape. A preferred embodiment for providing adjustability in the spacing between upper and lower claws involves the use of claws of the type shown in FIG. 5. There is illustrated a side elevational view of a claw member 20A having an elongated leg 21 which includes a plurality of vertically-spaced openings 21A. By removing a bolt 19 from the control device, claw 20A can be moved toward or away from opposing claw 30A and then secured at a desired position by inserting bolt 19 through the appropriate opening 21A. By providing a continuous slot or elongated aperture as shown, it is possible to adjust the position of claw 20A without having to completely remove the bolt 19.

The control devices of the invention are very easy for disabled persons to use, and the control devices are securely, but detachably, connected to a vehicle brake or accelerator pedal of any vehicle. The control devices are truly portable and can be connected to the desired pedals without tools or special equipment.

Other variants are possible without departing from the scope of this invention.

What is claimed is:

1. A portable control device for attachment to a vehicle foot pedal to enable hand control of the foot pedal by a disabled person, said device comprising:

(a) an elongated tubular body member having upper and lower ends; wherein said body member includes a first slotted opening extending transversely through said body member;

(b) opposing first and second claw means secured to said lower end of said body member; wherein said first claw means is movable between open and closed positions; wherein the spacing between said first and second claw means is adjustable; wherein said second claw means is secured to said lower end of said body member in a fixed position, and wherein said first claw means is pivotally mounted on said lower end of said body member;

(c) lever means extending downwardly through said body member for moving said first claw means between said open and closed positions; wherein said lever means includes a lower end;

(d) bias means disposed in said tubular member for biasing said first claw means toward said closed positions;

(e) a first collar member extending around said body member; wherein said lower end of said lever means is secured to said collar member through said slotted opening; and (f) a connecting arm connected between said collar member and said first claw means.

2. A control device in accordance with claim 1, further comprising a handle secured to said upper end of said body member.

3. A control device in accordance with claim 1, wherein said second claws means includes a base member having a plurality of mounting positions thereon for attachment to said lower end of said body member.

4. A control device in accordance with claim 3, wherein said plurality of mounting positions comprise a plurality of spaced-apart apertures extending through said base member; and further comprising a removable bolt for securing said base member to said lower end of said body member through a selected one of said apertures.

5. A control device in accordance with claim 4, wherein said first claw means is pivotally mounted on said bolt.

6. A control device in accordance with claim 1, wherein said first collar member is secured to said lower end of said lever means with a pin extending through said first collar member and said lower end of said lever means and through said first slotted opening.

7. A control device in accordance with claim 6, further comprising a second slotted opening extending transversely through said upper end of said body member; and further comprising a second collar member extending around said body member; wherein said lever means includes an upper end; wherein said second collar member is secured to said upper end of said lever means with a pin extending through said second collar member and said upper end of said lever means and through said second slotted opening.

8. A control device in accordance with claim 7, wherein said second collar member further comprises outwardly projecting ears to facilitate gripping thereof.

9. A control device in accordance with claim 1, wherein said first and second claw means each comprise a pair of spaced-apart claw members.

10. A portable control device for attachment to a vehicle foot pedal to enable hand control of the foot pedal by a disabled person, said device comprising:

(a) an elongated tubular body member having upper and lower ends; and further comprising handle secured to said upper end; wherein said body member includes a first slotted opening extending transversely through said body member;

(b) opposing first and second claw means secured to said lower end of said body member; wherein said first claw means is movable between open and closed positions; wherein the spacing between said first and second claw means is adjustable; wherein said second claw means is secured to said lower end of said body member in a fixed position, and wherein said first claw means is pivotally mounted on said lower end of said body member;

(c) lever means extending through said body member for moving said first claw means between said open and closed positions; wherein said lever means includes a lower end:

(d) bias means for biasing said first claw means toward said closed position;

(e) a first collar member extending around said body member; wherein said lower end of said lever means is secured to said collar member through said slotted opening; and (f) a connecting arm connected between said collar member and said first claw means.

11. A control device in accordance with claim 10, further comprising a second collar member extending around said body member and being secured to said upper end of said lever means; wherein said second collar member includes outwardly-projecting ears to facilitate gripping thereof.

12. A control device in accordance with claim 11, wherein said first and second claw means each comprise a pair of spaced-apart claw members.

13. A control device in accordance with claim 10, wherein said second claws means includes a base member having a plurality of mounting positions thereon for attachment to said lower end of said body member.

14. A control device in accordance with claim 13, wherein said plurality of mounting positions comprise a plurality of spaced-apart apertures extending through said base member; and further comprising a removable bolt for securing said base member to said lower end of said body member through a selected one of said apertures.

15. A control device in accordance with claim 14, wherein said first claw means is pivotally mounted on said bolt.

* * * * *